US010954942B2

(12) United States Patent
Seong et al.

(10) Patent No.: US 10,954,942 B2
(45) Date of Patent: Mar. 23, 2021

(54) SCROLL COMPRESSOR

(71) Applicant: LG Electronics Inc., Seoul (KR)

(72) Inventors: Sanghun Seong, Seoul (KR); Byungkil Yoo, Seoul (KR); Nayoung Jeon, Seoul (KR)

(73) Assignee: LG Electronics Inc., Seoul (KR)

( * ) Notice: Subject to any disclaimer, the term of this patent is extended or adjusted under 35 U.S.C. 154(b) by 330 days.

(21) Appl. No.: 15/996,883

(22) Filed: Jun. 4, 2018

(65) Prior Publication Data

US 2018/0363651 A1 Dec. 20, 2018

(30) Foreign Application Priority Data

Jun. 15, 2017 (KR) ..... 10-2017-0075949

(51) Int. Cl.
*F04C 28/18* (2006.01)
*F04C 28/02* (2006.01)
(Continued)

(52) U.S. Cl.
CPC ..... *F04C 28/18* (2013.01); *F04C 18/0215* (2013.01); *F04C 18/0261* (2013.01);
(Continued)

(58) Field of Classification Search
CPC .. F04C 28/18; F04C 18/0215; F04C 18/0261; F04C 23/008; F04C 27/005; F04C 28/26;
(Continued)

(56) References Cited

U.S. PATENT DOCUMENTS

2010/0254841 A1* 10/2010 Akei ..... F04C 18/0215 418/24
2014/0014087 A1 1/2014 Rosa et al.
(Continued)

FOREIGN PATENT DOCUMENTS

EP 0747597 12/1996
EP 1025403 8/2000
(Continued)

OTHER PUBLICATIONS

International Search Report and Written Opinion in International Application No. PCT/KR2018/006371, dated Sep. 21, 2018, 18 pages (with English Translation).
(Continued)

*Primary Examiner* — Deming Wan
(74) *Attorney, Agent, or Firm* — Fish & Richardson P.C.

(57) ABSTRACT

A scroll compressor includes a casing accommodating a rotary shaft and a driving unit, a first scroll making an orbiting movement by the rotary shaft, a second scroll engaged with the first scroll to form a compression chamber and having a bypass hole bypassing a refrigerant sucked into the compression chamber to an internal space of the casing, and a back-pressure chamber assembly pressing the second scroll toward the first scroll, wherein the back-pressure chamber assembly includes: a back-pressure space, a first valve unit allowing the bypass hole and the internal space of the casing to selectively communicate with each other, and a second valve unit opened and closed to selectively supply the refrigerant of the back-pressure space to the first valve unit to operate the first valve unit, and positioned to be fixed to the casing.

20 Claims, 11 Drawing Sheets

(51) Int. Cl.

| | |
|---|---|
| ***F04C 23/00*** | (2006.01) |
| ***F04C 27/00*** | (2006.01) |
| ***F04C 28/26*** | (2006.01) |
| ***F01C 1/02*** | (2006.01) |
| ***F04C 29/00*** | (2006.01) |
| ***F04C 18/02*** | (2006.01) |

(52) U.S. Cl.
CPC ..... *F04C 23/008* (2013.01); *F04C 27/005* (2013.01); *F04C 28/26* (2013.01); *F04C 28/265* (2013.01); *F04C 2210/26* (2013.01); *F04C 2240/20* (2013.01); *F04C 2240/30* (2013.01)

(58) Field of Classification Search
CPC ... F04C 28/265; F04C 29/0021; F01C 1/0253
See application file for complete search history.

(56) References Cited

U.S. PATENT DOCUMENTS

| | | | | |
|---|---|---|---|---|
| 2014/0140876 | A1* | 5/2014 | Bingham | F04C 18/0215 418/55.1 |
| 2014/0219846 | A1* | 8/2014 | Ignatiev | F04C 28/18 418/16 |
| 2016/0032924 | A1* | 2/2016 | Stover | F04C 27/005 418/55.5 |

FOREIGN PATENT DOCUMENTS

| | | |
|---|---|---|
| EP | 3249229 | 11/2017 |
| EP | 3354899 | 8/2018 |
| KR | 1020050100302 | 10/2005 |
| KR | 1020100081814 | 7/2010 |
| KR | 1020120008045 | 1/2012 |
| KR | 101731449 | 4/2017 |
| KR | 101800261 | 11/2017 |

OTHER PUBLICATIONS

European Search Report in European Application No. 18177589.1, dated Oct. 22, 2018, 11 pages.

* cited by examiner

SCROLL COMPRESSOR

CROSS-REFERENCE TO RELATED APPLICATION

Pursuant to 35 U.S.C. § 119(a), this application claims the benefit of earlier filing date and right of priority to Korean Application No. 10-2017-0075949, filed on Jun. 15, 2017, the contents of which is incorporated by reference herein in its entirety.

FIELD

The present disclosure relates to a scroll compressor, and more particularly to a scroll compressor having a capacity varying device.

BACKGROUND

A scroll compressor is a compressor in which a non-orbiting scroll is installed in an internal space of a casing and an orbiting scroll is engaged with the non-orbiting scroll to make an orbiting movement to form a pair of two compression chambers each including a suction chamber, an intermediate pressure chamber, and a discharge chamber between a non-orbiting wrap of the non-orbiting scroll and an orbiting wrap of the orbiting scroll.

Scroll compressors may obtain a high compression ratio, compared with other types of compressors. Also, due to advantages of smoothly performing sucking, compressing, and discharging operations on a fluid to obtain stable torque, scroll compressors have widely been used for compressing a refrigerant in air-conditioning devices, or the like.

The scroll compressor may be divided into a high-pressure type and a low-pressure type according to types of refrigerants supplied to a compression chamber. In the high-pressure type scroll compressor, a refrigerant is sucked directly into a suction chamber without passing through an internal space of a casing and is subsequently discharged through the internal space of the casing. Most of the internal space of the casing forms a discharge space which is a high-pressure portion. Meanwhile, in the low-pressure type scroll compressor, a refrigerant is indirectly sucked into a suction chamber through an internal space of a casing, and the internal space of the casing is divided by a high and low-pressure separator into a suction space which is a low-pressure portion and a discharge space which is a high-pressure portion.

FIG. 1 is a longitudinal sectional view illustrating a related art low-pressure scroll compressor, and FIGS. 2A and 2B are longitudinal sectional views illustrating power operation and saving operation states of the scroll compressor illustrated in FIG. 1.

As illustrated FIG. 1, the related art low-pressure scroll compressor has a driving motor 20 for generating a rotational force in an internal space 11 of a sealed casing 10 and a main frame 30 installed above the driving motor 20.

On an upper surface of the main frame 30, an orbiting scroll 40 is rotatably supported by an oldam ring (not shown), and a non-orbiting scroll 50 is engaged with an upper side of the orbiting scroll 40 to form a compression chamber P.

A rotary shaft 25 is coupled to a rotor 22 of the driving motor 20 and the orbiting scroll 40 is eccentrically coupled to the rotary shaft 25. The non-orbiting scroll 50 is coupled to the main frame 30 such that rotation thereof is restrained A back-pressure chamber assembly 60 for restraining floating of the non-orbiting scroll 50 due to pressure of the compression chamber P during operation is coupled to an upper side of the non-orbiting scroll 50. A back-pressure space 60*a* filled with a refrigerant having intermediate pressure is formed in the back-pressure chamber assembly 60.

A high and low-pressure separator 15 is installed above the back-pressure chamber assembly 60 to support a rear surface of the back-pressure chamber assembly 60 and separating an internal space 11 of the casing 10 into a suction space 11 as a low-pressure part and a discharge space 12 as a high-pressure part.

The high and low-pressure separator 15 has an outer circumferential surface tightly attached to and welded to an inner circumferential surface of the casing 10 and has a discharge hole 15*a* formed at the center thereof and communicating with a discharge hole 54 of the non-orbiting scroll 50.

In FIG. 1, reference numeral 13 denotes a suction pipe, reference numeral 14 denotes a discharge tube, reference numeral 18 denotes a subframe, reference numeral 21 denotes a stator, reference numeral 21*a* denotes a winding coil, reference numeral 41 denotes a disk plate part of the orbiting scroll, reference numeral 42 denotes an orbiting wrap, reference numeral 52 denotes a non-orbiting wrap, and reference numeral 53 is a suction hole.

In the related art scroll compressor, when power is applied to the driving motor 20 to generate rotational force, the rotary shaft 25 transfers rotational force of the driving motor 20 to the orbiting scroll 40.

Then, the orbiting scroll 40 is pivotally moved relative to the non-orbiting scroll 50 by the oldam ring, forming a pair of two compression chambers P between the orbiting scroll 40 and the non-orbiting scroll 50 to suck, compress, and discharge a refrigerant.

Here, a portion of the refrigerant compressed in the compression chamber P moves from the intermediate pressure chamber to the back-pressure space 60*a* through a back-pressure hole (not shown), and the refrigerant having the intermediate pressure introduced to the back-pressure space 60*a* generates back-pressure to cause a floating plate 65 forming the back-pressure chamber assembly 60 to float. The floating plate 65 is brought into close contact with a lower surface of the high and low-pressure separator 15 to separate the suction space 11 and the discharge space 12 from each other and the non-orbiting scroll 50 is pressed toward the orbiting scroll 40 to maintain airtightness of the compression chamber P between the non-orbiting scroll 50 and the orbiting scroll 40.

Here, like any other compressor, compression capacity of the scroll compressor may be varied according to demand of a refrigerating (or freezing) machine to which the compressor is applied. To this end, as illustrated, a modulation ring 61 and a lift ring 62 are additionally provided on the disk plate part 51 of the non-orbiting scroll 50, and a control valve 63 communicating with the back-pressure space 60*a* through a first communication path 61*a* is provided on one side of the modulation ring 61. A second communication path 61*b* is formed between the modulation ring 61 and the lift ring 62 and a third communication path 61*c* is formed between the modulation ring 61 and the non-orbiting scroll 50 and opened when the modulation ring 61 floats. One end of the third communication path 61*c* communicates with the intermediate compression chamber and the other end thereof communicates with the suction space 11 of the casing 10.

In the scroll compressor, in the case of power operation, as illustrated in FIG. 2A, the control valve 63 closes the first communication path 61*a* and causes the second communication path 61*b* to communicate with the suction space 11 to prevent the bypass hole 51*a* from floating so that the bypass hole 51*a* and the third communication path 61*c* are maintained in a closed state.

Meanwhile, in the case of saving operation, the control valve 63 causes the first communication path 61*a* and the second communication path 61*b* to communicate with each other to allow the modulation ring 61 to float, and accordingly, the bypass hole 51*a* and the second communication path 61*b* are opened to cause a portion of a refrigerant of the intermediate compression chamber to be leaked to the suction space 11 to reduce capacity of the compressor.

However, a capacity varying device of the related art scroll compressor is composed of the modulation ring 61, the lift ring 62, and the control valve 63, and thus, the number of components thereof is large. Also, since the first communication path 61*a*, the second communication path 61*b*, and the third communication path 61*c* are formed, the structure of the modulation ring 61 is complicated.

In addition, the modulating ring 61 must be lifted up quickly using the refrigerant in the back-pressure space 60*a*. However, the modulation ring 61 has an annular shape and since the control valve 63 is coupled, the weight of the assembly to be driven is increased to increase consumption of driving power and it is difficult to perform modulation quickly.

SUMMARY

Therefore, an aspect of the detailed description is to provide a scroll compressor in which the amount of moving components may be minimized and capacity may be varied by a simple piping structure.

Another object of the present disclosure is to provide a scroll compressor which has a simple piping structure and in which capacity may be varied, while minimizing the amount of lost refrigerant.

To achieve these and other advantages and in accordance with the purpose of this specification, as embodied and broadly described herein, a scroll compressor includes: a casing accommodating a rotary shaft and a driving unit; a first scroll making an orbiting movement by the rotary shaft; a second scroll engaged with the first scroll to form a compression chamber and having a bypass hole bypassing a refrigerant sucked into the compression chamber to an internal space of the casing; and a back-pressure chamber assembly pressing the second scroll toward the first scroll, wherein the back-pressure chamber assembly includes: a back-pressure space; a first valve unit allowing the bypass hole and the internal space of the casing to selectively communicate with each other; and a second valve unit opened and closed to selectively supply the refrigerant of the back-pressure space to the first valve unit to operate the first valve unit, and positioned to be fixed to the casing.

To achieve these and other advantages and in accordance with the purpose of this specification, as embodied and broadly described herein, a scroll compressor includes: a casing accommodating a rotary shaft and a driving unit; a first scroll making an orbiting movement by the rotary shaft; a second scroll engaged with the first scroll to form a compression chamber and having a bypass hole bypassing a refrigerant sucked into the compression chamber to an internal space of the casing; and a back-pressure chamber assembly pressing the second scroll toward the first scroll, wherein the back-pressure chamber assembly includes: a back-pressure space; a first valve unit allowing the bypass hole and the internal space of the casing to selectively communicate with each other; and a second valve unit positioned to be fixed to the casing and allowing a valve space formed in the first valve unit and the internal space of the casing to selectively communicate with each other to operate the first valve unit.

To achieve these and other advantages and in accordance with the purpose of this specification, as embodied and broadly described herein, a scroll compressor includes: a casing having a rotary shaft; a driving unit rotating the rotary shaft; a first scroll accommodated in the casing and connected to the rotary shaft to make an orbiting movement; a second scroll engaged with the first scroll to form a compression chamber and having a bypass hole bypassing a refrigerant sucked into the compression chamber to an internal space of the casing; and a back-pressure chamber assembly pressing the second scroll toward the first scroll, wherein the back-pressure chamber assembly includes: a back-pressure space communicating with the compression chamber to accommodate a refrigerant having intermediate pressure; a first valve unit allowing the bypass hole and the internal space of the casing to selectively communicate with each other according to operation modes; and a second valve unit positioned to be fixed to the casing, having an inlet receiving a refrigerant from the back-pressure space and an outlet supplying the refrigerant to the first valve unit, and operating the first valve unit by allowing the inlet and the outlet to communicate with each other or closing the inlet and the outlet.

The first valve unit may include a bypass valve moved to be spaced apart from the bypass hole or brought into close contact with the bypass hole; and a valve space movably accommodating the bypass valve.

The first valve unit may further include a discharge groove allowing the bypass hole and the internal space of the casing to communicate with each other when the bypass valve and the bypass hole are separated from each other.

The first valve unit may further include a leakage passage formed by a gap between the valve space and the bypass valve and communicating with the discharge groove.

The first valve unit may further include a leakage passage formed by a gap between the valve space and the bypass valve, and a flow path cross-sectional area of the leakage passage may be smaller than a flow path cross-sectional area of an outlet passage.

The second valve unit may further include: an inlet passage allowing the inlet and the back-pressure space to communicate with each other; and an outlet passage allowing the outlet and the valve space to communicate with each other.

The second valve may further include: a valve housing having the inlet and the outlet and installed on an outer circumferential surface of the casing; a communication space allowing the inlet and the outlet to communicate with each other inside the valve housing; and an opening and closing member moved to allow the inlet and the outlet to communicate with each other or close the inlet and the outlet inside the communication space.

The back-pressure chamber assembly may include: a back-pressure plate brought into contact with and pressed to the second scroll; a leakage passage penetrating through the back-pressure plate to allow the valve space and the internal space of the casing to communicate with each other; and a pressure reducing member insertedly installed inside the leakage passage.

The first valve unit may further include a sealing member installed on an inner surface of the valve space and brought into close contact with the bypass valve to slide.

To achieve these and other advantages and in accordance with the purpose of this specification, as embodied and broadly described herein, a scroll compressor includes: a casing having a rotary shaft; a driving unit rotating the rotary shaft; a first scroll accommodated in the casing and connected to the rotary shaft to make an orbiting movement; a second scroll engaged with the first scroll to form a compression chamber and having a bypass hole bypassing a refrigerant sucked into the compression chamber to an internal space of the casing; and a back-pressure chamber assembly pressing the second scroll toward the first scroll, wherein the back-pressure chamber assembly includes: a back-pressure space communicating with the compression chamber to accommodate a refrigerant having intermediate pressure; a first valve unit receiving the refrigerant from the back-pressure space and allowing the bypass hole and the internal space of the casing to selectively communicate with each other according to operation modes; and a second valve unit positioned to be fixed to the casing, having an inlet receiving the refrigerant from the first valve unit and an outlet discharging the refrigerant to the internal space of the casing, and operating the first valve unit by allowing the inlet and the outlet to communicate with each other or closing the inlet and the outlet.

The first valve unit may include: a bypass valve moved to be spaced apart from the bypass hole or brought into close contact with the bypass hole; and a valve space movably accommodating the bypass valve, wherein the second valve unit further includes: an inlet passage allowing the inlet and the valve space to communicate with each other; and an outlet passage allowing the outlet and the internal space of the casing to communicate with each other.

The back-pressure chamber assembly may further include: an intermediate pressure passage allowing the back-pressure space and the valve space to communicate with each other; and a pressure reducing member insertedly installed inside the intermediate pressure passage.

The second valve unit may further include: a valve housing having the inlet and the outlet and installed on an outer circumferential surface of the casing; a communication space allowing the inlet and the outlet to communicate with each other inside the valve housing; and an opening and closing member moved to allow the inlet and the outlet to communicate with each other or close the inlet and the outlet inside the communication space.

To achieve these and other advantages and in accordance with the purpose of this specification, as embodied and broadly described herein, a scroll compressor includes: a casing accommodating a rotary shaft and a driving unit rotating the rotary shaft; a first scroll connected to the rotary shaft to make orbiting movement; a second scroll engaged with the first scroll to form a compression chamber and having a bypass hole bypassing a refrigerant sucked into the compression chamber to an internal space of the casing; and a back-pressure chamber assembly pressing the second scroll toward the first scroll, wherein the back-pressure chamber assembly includes: a first valve unit moved to be spaced apart from the second scroll or brought into close contact with the second scroll to open or close the bypass hole; and a second valve unit positioned to be fixed to the casing and selectively supplying refrigerants having different pressures to the first valve unit to implement the separation or close contact operation.

The present disclosure has the following effects.

The scroll compressor according to the present disclosure is configured such that the first valve unit brought into close contact with the bypass hole is driven by the second valve unit positioned to be fixed to the casing. Accordingly, the number of components to be moved to form back-pressure or to vary capacity may be minimized, reducing power.

Further, the second valve unit may have a simple structure in which the inlet and the outlet communicate with each other or are closed. Accordingly, compared to the related art structure in which the communication path is complicated, capacity may be varied with a simple structure, reducing manufacturing cost.

The scroll compressor according to the present disclosure may include the leakage passage allowing the valve space and the suction space to communicate with each other and the and the pressure reducing member. Accordingly, the bypass valve may be accurately operated between pressures of the back-pressure space and the suction space, further ensuring reliability of the capacity varying operation.

Furthermore, in the scroll compressor according to the present disclosure, the suction space and the valve space may be configured to selectively communicate with each other by the second valve unit. Accordingly, the suction space and the valve space may be operated to close each other in the power mode, and the amount of refrigerant that may be leaked when capacity is varied may be reduced.

Further scope of applicability of the present application will become more apparent from the detailed description given hereinafter. However, it should be understood that the detailed description and specific examples, while indicating preferred embodiments of the invention, are given by way of illustration only, since various changes and modifications within the scope of the invention will become apparent to those skilled in the art from the detailed description.

BRIEF DESCRIPTION OF THE DRAWINGS

The accompanying drawings, which are included to provide a further understanding of the invention and are incorporated in and constitute a part of this specification, illustrate exemplary embodiments and together with the description serve to explain the principles of the invention.

In the drawings.

DETAILED DESCRIPTION

Figure 1:
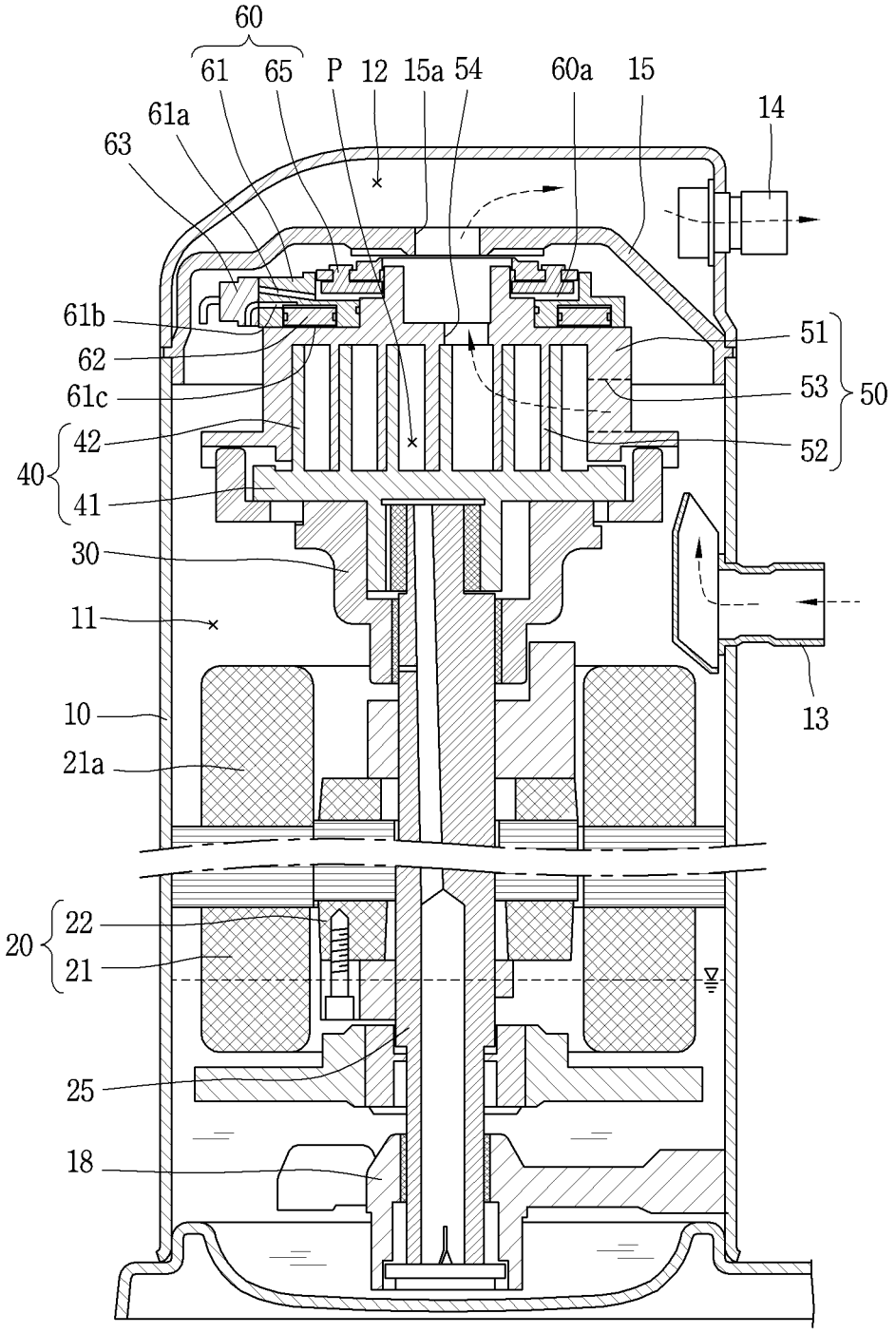
FIG. 1 RELATED ART
FIG. 1 is a longitudinal sectional view of the related art low-pressure scroll compressor.
Figure 2A:
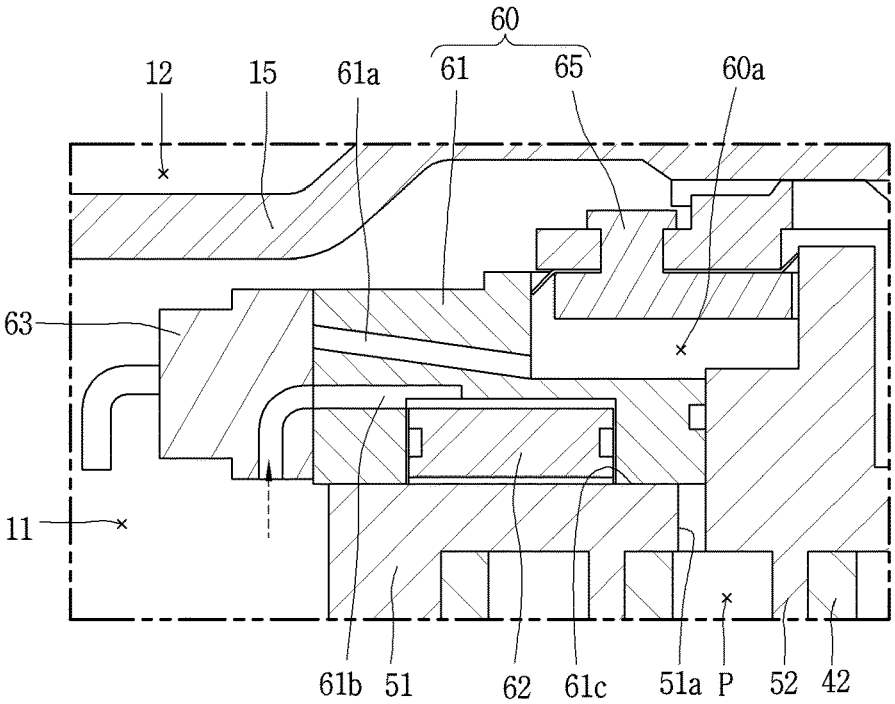
FIG. 2A RELATED ART
FIGS. 2A and 2B are longitudinal sectional views illustrating a power operation stage and a saving operation state of the scroll compressor illustrated in FIG. 1, respectively.
Figure 2B:
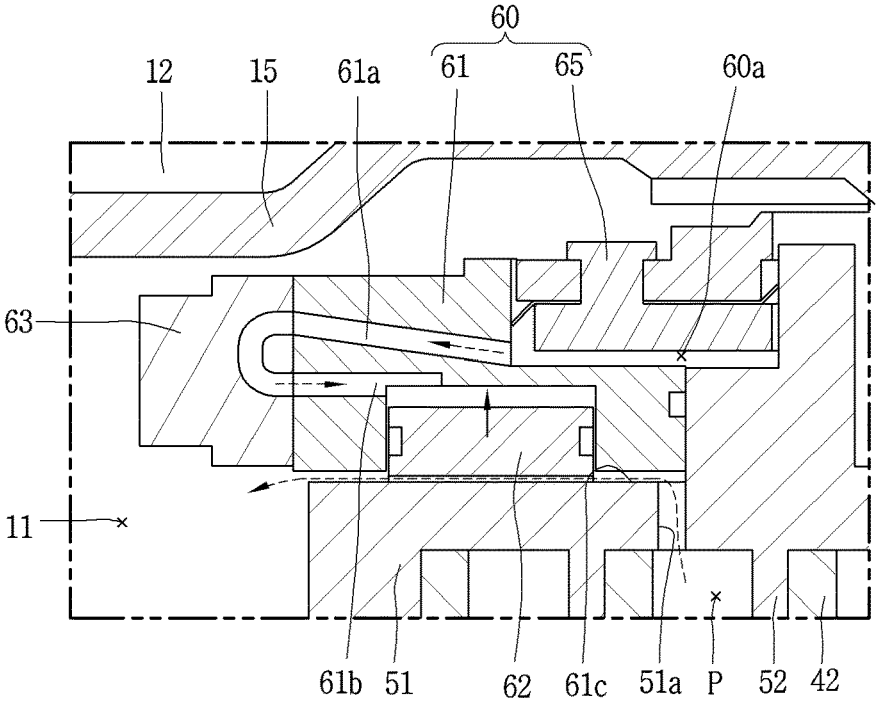
FIG. 2B RELATED ART

Hereinafter, a scroll compressor according to the present disclosure will be described in detail with reference to the drawings.

In the different embodiments, the same or similar reference numerals are given to the same or similar components which are included in a previous embodiment and a redundant description thereof will be omitted.

The accompanying drawings are provided for the purpose of easily understanding embodiments disclosed in this disclosure only and not intended to be limiting of the invention and include all modifications, equivalents, and substitutions without departing from the scope and spirit of the present invention.

Figure 3:
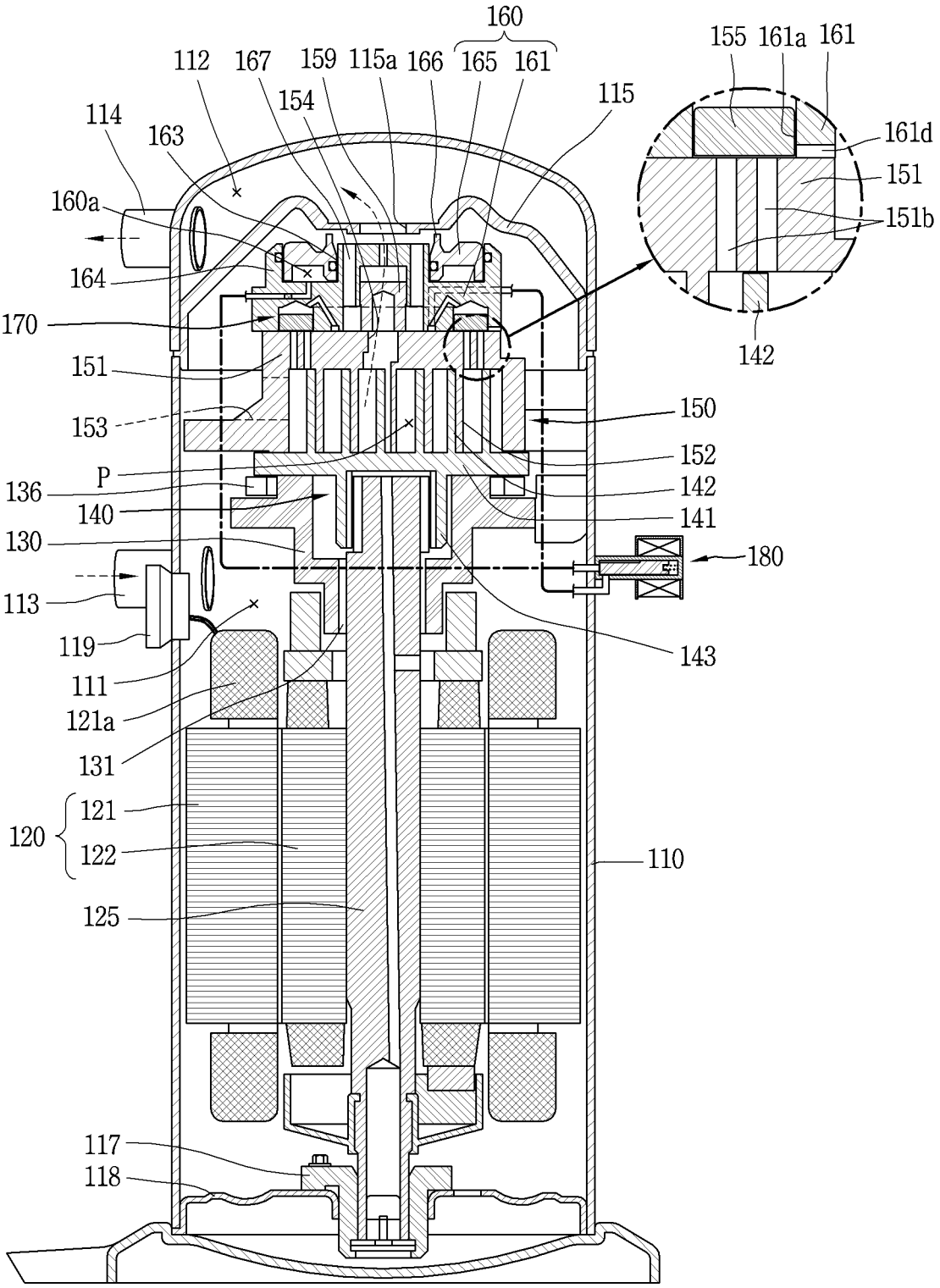
FIG. 3 is a longitudinal sectional view of a scroll compressor according to an embodiment of the present disclosure.
Figure 4:
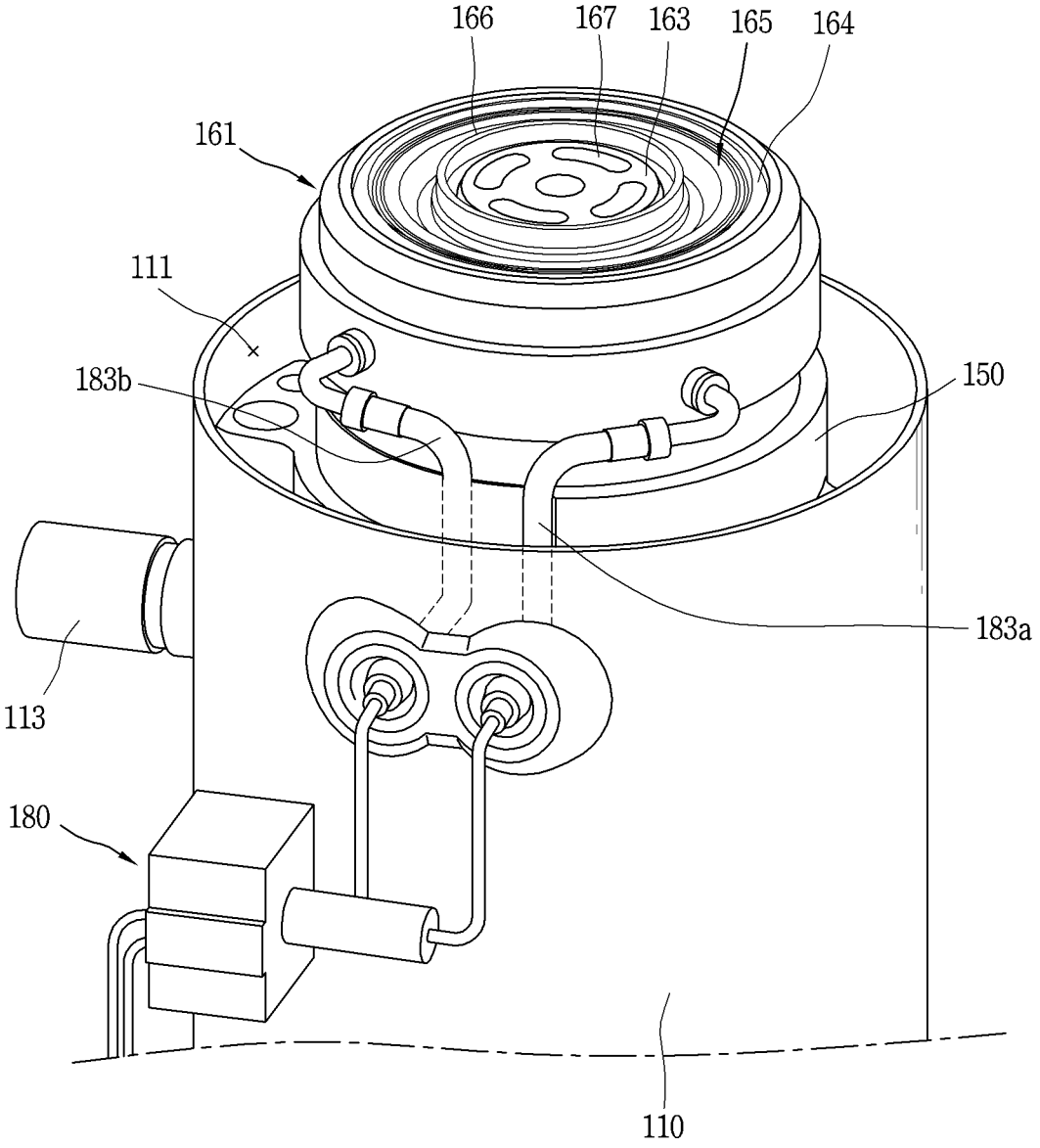
FIG. 4 is a perspective view of the scroll compressor illustrated in FIG. 3 without a part of a casing and a high and low-pressure separator.
Figure 5:
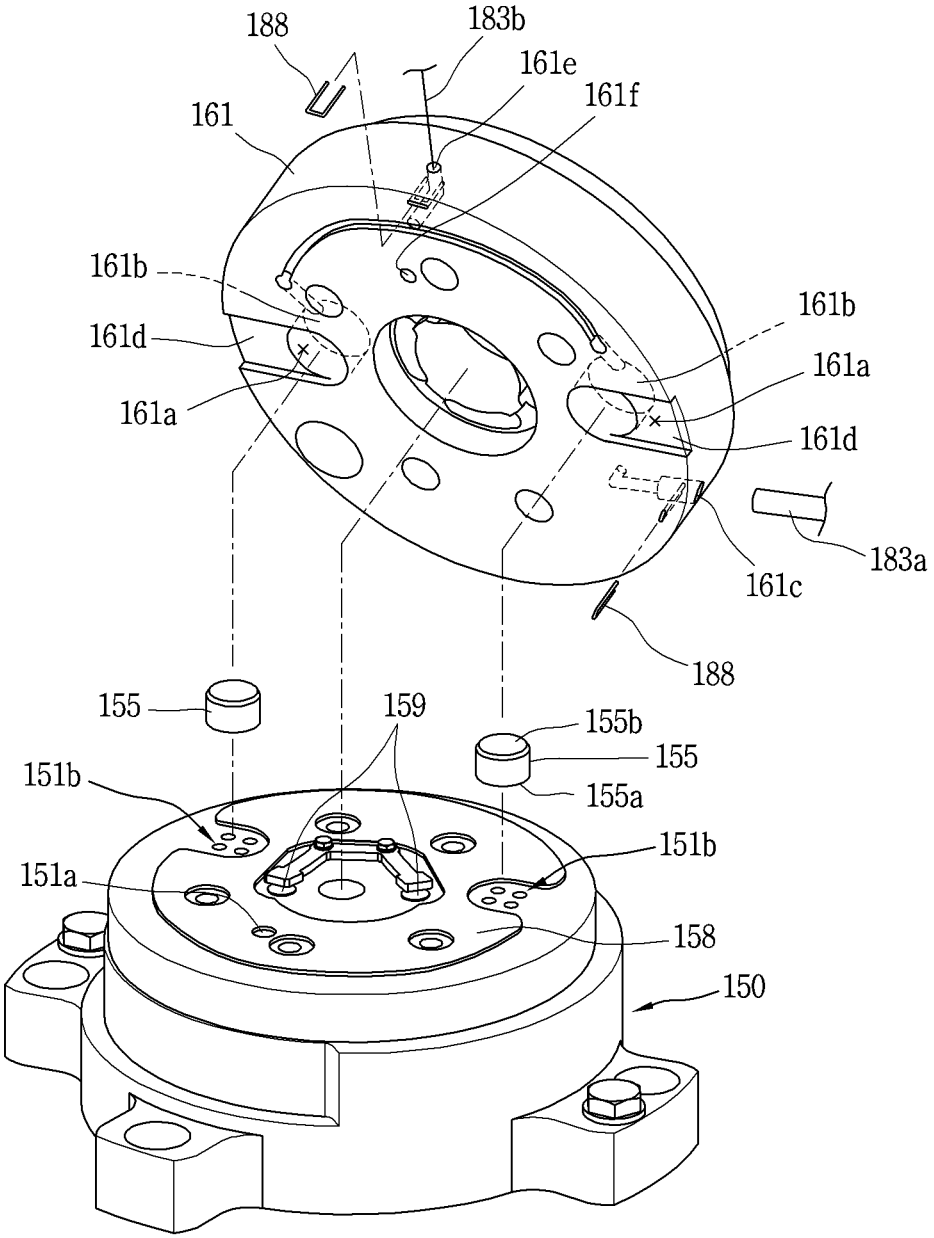
FIG. 5 is an exploded perspective view of a second scroll and a back-pressure chamber assembly illustrated in FIG. 4.

FIG. 3 is a vertical sectional view illustrating a scroll compressor according to an embodiment of the present disclosure, and FIG. 4 is a perspective view of the scroll compressor illustrated in FIG. 3. FIG. 5 is an exploded perspective view of a second scroll and back-pressure chamber assembly illustrated in FIG. 4.

In a scroll compressor according to the present embodiment, a sealed internal space of the casing 110 is divided into a suction space 111 as a low-pressure part and a discharge space 112 as a high-pressure part by a high and low-pressure separator 115 provided above a non-orbiting scroll 150 (hereinafter, also referred to as a second scroll). Here, the suction space 111 may be a lower space of the high and low-pressure separator 115 and the discharge space 112 may be an upper space of the high and low-pressure separator.

A suction pipe 113 communicating with the suction space 111 and a discharge pipe 114 communicating with the discharge space 112 are fixed to the casing 110 to suck a refrigerant into the internal space of the casing 110 or discharge the refrigerant to the outside of the casing 110.

A driving motor 120 including a stator 121 and a rotor 122 may be provided in the suction space 111 of the casing 110. The stator 121 is fixed to an inner wall surface of the casing 110 in a shrinkage fitting manner and a rotary shaft 125 may be inserted into a central portion of the rotor 122. A coil 121*a* may be wound around the stator 121 and may be electrically connected to an external power source through a terminal 119 which is coupled to the casing 110 in a penetrating manner as illustrated in FIGS. 3 and 4.

A lower end of the rotary shaft 125 is rotatably supported by an auxiliary bearing 117 installed at a lower portion of the casing 110. The auxiliary bearing 117 is supported by the lower frame 118 fixed to an inner surface of the casing 110 to stably support the rotary shaft 125. The lower frame 118 may be welded to the inner wall surface of the casing 110 and a bottom surface of the casing 110 may be used as an oil storage space. Oil stored in the oil storage space is transferred to an upper side by the rotary shaft 125, or the like, and the oil enters the driving unit and the compression chamber to perform lubrication.

An upper portion of the rotary shaft 125 may be rotatably supported by the main frame 130. The main frame 130 may be fixed to an inner wall surface of the casing 110 together with the lower frame 118, a downwardly protruding main bearing part 131 may be formed on a lower surface of the main frame 130. The rotary shaft 125 may be inserted into the main bearing part 131. An inner wall surface of the main bearing part 131 serves as a bearing surface and may support the rotary shaft 125 together with the aforementioned oil such that the rotary shaft 125 may be smoothly rotated.

An orbiting scroll (hereinafter also referred to as a first scroll) 140 is disposed on an upper surface of the main frame 130. The first scroll 140 includes a first disk plate part 141 having a substantially disk shape and an orbiting wrap (hereinafter referred to as a first wrap 142) formed in a spiral shape on one side of the first disk plate part 141. The first wrap 142 forms the compression chamber P together with the second wrap 152 of the second scroll 150 to be described later.

The first disk plate part 141 of the first scroll 140 is driven in an orbiting manner, in a state of being supported on an upper surface of the main frame 130, and here, an oldam ring 136 is installed between the first disk plate part 141 and the main frame 130 to prevent the first scroll 140 from rotating.

A boss part 143 is formed on a lower surface of the first disk plate part 141 of the first scroll 140 to receive the rotary shaft 125. Accordingly, rotational power of the rotary shaft 125 may cause the first scroll 140 to make an orbiting movement.

A second scroll 150 engaged with the first scroll 140 is disposed on top of the first scroll 140. Here, the second scroll 150 is installed to be movable up and down with respect to the first scroll 140. More specifically, a plurality of guide pins (not shown) fitted to the main frame 130 are inserted into a plurality of guide holes (not shown) formed on an outer circumferential portion of the second scroll 150 and, in this state, the plurality of guide pins are mounted on and supported by an upper surface of the main frame 130.

The second scroll 150 may include a second disk plate part 151 formed in the form of a disk in an upper part thereof and a second wrap 152 spirally formed to be engaged with the first wrap 142 of the first scroll 140 in a lower part thereof.

A suction hole 153 for sucking a refrigerant existing in the suction space 111 is formed on a side surface of the second scroll 150 and a discharge hole 154 for discharging a compressed refrigerant may be disposed in a substantially central portion of the second disk plate part 151.

As described above, the first wrap 142 and the second wrap 152 form a plurality of compression chambers P, and the compression chambers are reduced in volume, while rotatably moving toward the discharge hole 154, to compress the refrigerant. Accordingly, pressure in the compression chamber adjacent to the suction hole 153 is minimized, and pressure in the compression chamber communicating with the discharge hole 154 is maximized.

Pressure in the compression chamber existing between the suction hole 153 side and the discharge hole 154 side forms an intermediate pressure having a value between the suction pressure and the discharge pressure. The intermediate pressure is applied to a back-pressure space 160*a* (to be described later) to press the second scroll 150 toward the first scroll 140, and thus, a scroll side back-pressure hole 151*a* through which the refrigerant is discharged may be formed on the second disk plate part 151 and communicate with one of the region having the intermediate pressure.

A back-pressure plate 161 constituting a part of the back-pressure chamber assembly 160 is fixed to an upper portion of the second disk plate part 151 of the second scroll 150. The back-pressure plate 161 may have a substantially annular shape and may be in contact with the second disk plate part 151 of the second scroll 150. The back-pressure plate 161 may be formed with a plate side back-pressure hole 161*f* communicating with the scroll side back-pressure hole 151*a*.

First and second annular walls 163 and 164 may be formed at an upper end of the back-pressure plate 161. A back-pressure space 160*a* may be formed between an outer circumferential surface of the first annular wall 163 and an inner circumferential surface of the second annular wall 164.

On the upper side of the back-pressure space 160*a*, a floating plate 165 constituting an upper surface of the back-pressure space 160*a* may be provided. Here, a sealing end 166 may be provided at an upper end of the internal space portion of the floating plate 165. The sealing end 166 may protrude upwards from a surface of the floating plate 165, and an inner diameter of the sealing end 166 is formed so as not to cover the intermediate discharge hole 167. The sealing end 166 is in contact with a lower surface of the aforementioned high and low-pressure separator 115 and sealed so that the discharged refrigerant is discharged to the discharge space 112 without leaking into the suction space 111.

Reference numeral 158 denotes a gasket, 159 denotes a check valve for blocking the refrigerant discharged to the discharge space from flowing back to the compression chamber, and 188 denotes a fixing pin for fixing a connection pipe.

The scroll compressor according to this embodiment operates as follows.

When power is applied to the stator 121, the rotary shaft 125 rotates together with the rotor 122. The first scroll 140 coupled to the upper end of the rotary shaft 125 makes an orbiting movement with respect to the second scroll 150, and accordingly, a pair of two compression chambers P are formed between the first wrap 142 and the second wrap 152, and the two compression chamber P are reduced in volume, while moving from an outer side to an inner side to suck, compress, and discharge a refrigerant.

Here, a portion of the refrigerant moving along the compression chamber P moves to the back-pressure space 160*a* through the scroll side back-pressure hole 151*a* and the plate side back-pressure hole 161*f* before reaching the discharge opening 154. Accordingly, the back-pressure space 160*a* formed by the back-pressure plate 161 and the floating plate 165 forms an intermediate pressure.

Accordingly, the floating plate 165 is brought into close contact with the high and low-pressure separator 115 upon receiving pressure upwards and the internal space of the casing 110 is divided into the discharge space 112 and the suction space 111, so that the refrigerant discharged to the discharge space 112 is prevented from leaking to the suction space 111. Meanwhile, the back-pressure plate 161 receives pressure downwards to press the second scroll 150 toward the first scroll 140. The second scroll 150 is then brought into close contact with the first scroll 140 so that the refrigerant compressed in the compression chamber P may be prevented from leaking between the first scroll 140 and the second scroll 150.

The refrigerant sucked into the suction space 111 of the casing 110 is compressed in the compression chamber P and discharged to the discharge space 112. The refrigerant discharged to the discharge space 112 is circulated in a refrigerating cycle and then sucked into the suction space 111 again. This series of processes are repeatedly performed.

Meanwhile, the scroll compressor 100 according to an embodiment of the present disclosure may be configured to perform a full load operation (hereinafter, referred to as a power operation) or a partial load operation (or a saving operation) as necessary in an applied system. Hereinafter, a structure in which capacity is varied according to an embodiment of the present disclosure will be described on the basis of the back-pressure chamber assembly 160.

Figure 6A:
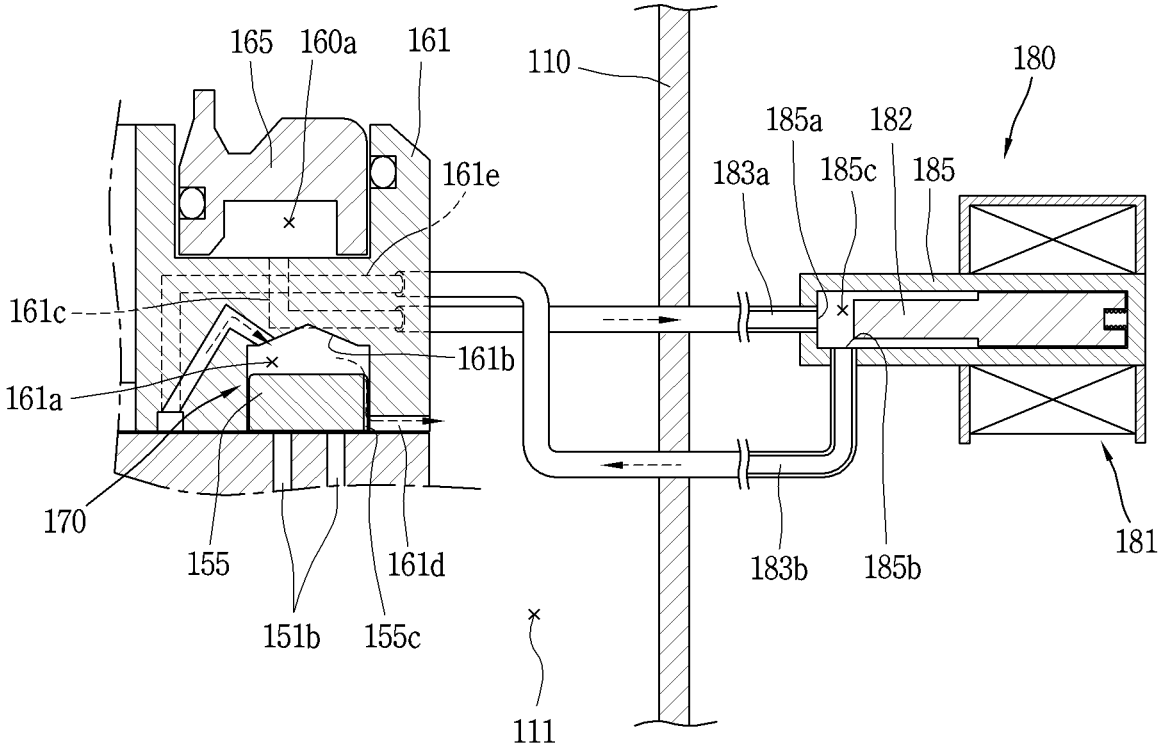
FIGS. 6A and 6B are conceptual views illustrating operational states of the back-pressure chamber assembly illustrated in FIG. 3 according to operation modes.
Figure 6B:
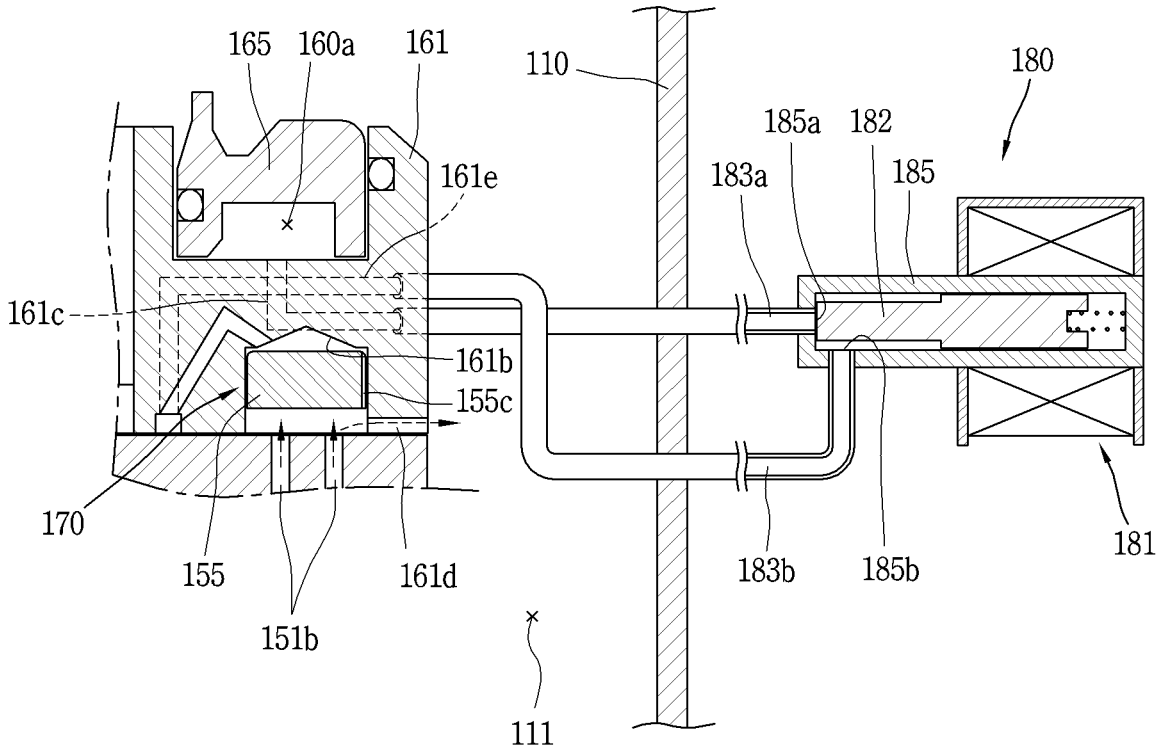

FIGS. 6A and 6B are conceptual views illustrating operational states of the back-pressure chamber assembly 160 illustrated in FIG. 3 according to operation modes. As illustrated, the back-pressure chamber assembly 160 according to the present disclosure includes a first valve unit 170 and a second valve unit 180.

The first valve unit 170 directly opens and closes a bypass hole 151*b* formed in the second scroll 150. Here, the bypass hole 151*b* penetrates through the second disk plate part 151 of the second scroll 150 and allows an intermediate pressure chamber and an internal space (in particular, the suction space 111) of the casing to communicate with each other so that the refrigerant having intermediate pressure may be bypassed.

Specifically, the first valve unit 170 may include a bypass valve 155 and a valve space 161*a*. The bypass valve 155 may be brought into contact with an upper surface of the second disk plate part 151 to close the bypass hole 151*b* and may be upwardly separated from the bypass hole 151*b* to open the bypass hole 151*b*.

This bypass valve 155 may be accommodated in the valve space 161*a* formed in the back-pressure plate 161. The valve space 161*a* may be formed to be recessed upwards from a lower surface of the back-pressure plate 161 facing the second scroll 150 (in particular, the bypass valve 155).

In particular, a differential pressure space 161*b*, which is sloped to be spaced apart from the bypass valve 155 even when the bypass valve 155 is completely lifted within the valve space 161*a*, may be formed in the valve space 161*a*. That is, the valve space 161*a* may accommodate the refrigerant so as to move the bypass valve 155 by pressure.

In addition, the first valve unit 170 may include a discharge groove 161*d* so that the refrigerant may be discharged more smoothly when the bypass hole 151*b* is opened. The discharge groove 161*d* may be formed to allow the bypass hole 151*b* and the suction space 111 to communicate with each other when the bypass valve 155 and the bypass hole 151*b* are separated from each other.

the bypass hole 151*b* and the suction space 111 with each other when the bypass valve 155 and the bypass hole 151*b* are separated from each other. For example, the discharge groove 161*d* is recessed on the lower surface of the back-pressure plate 161, and one end thereof may be connected to the valve space 161*a* and the other end may extend to be opened toward the outer circumferential surface of the back-pressure plate 161.

Meanwhile, the second valve unit 180 serves to open and close the first valve unit 170. In the present disclosure, the second valve unit 180 may be a 2-way valve having one inlet 185*a* and one outlet 185*b*. As the inlet 185*a* and the outlet 185*b* communicate with each other or are closed, the bypass valve 155 of the first valve unit 170 may be moved up and down.

Specifically, the second valve unit 180 may include the inlet 185*a*, the outlet 185*b*, a valve housing 185, a communication space 185*c*, and an opening and closing member 182. A refrigerant is introduced to or discharged from the inlet 185*a* and the outlet 185*b*, and the communication space 185*c* is formed inside the valve housing 185 so that the inlet 185*a* and the outlet 185*b* may communicate with each other. The opening and closing member may be moved according to power supply inside the communication space 185*c* to allow the inlet 185*a* and the outlet 185*b* to communicate with each other or to close the inlet 185*a* and the outlet 185*b*. As a result, the second valve unit 180 of the present disclosure may perform ON/OFF operation to open or close the inlet 185*a* and the outlet 185*b*.

The inlet 185*a* of the second valve unit 180 may be provided with an inlet passage 183*a* connected to the back-pressure space 160*a*. That is, the intermediate pressure refrigerant may be introduced to the inlet 185*a* of the second valve unit 180 through the inlet passage 183*a*. An outlet passage 183*b* communicating with the valve space 161*a* may be connected to the outlet 185*b* of the second valve unit 180. When the second valve unit 180 is opened, the intermediate pressure refrigerant introduced to the inlet 185*a* may flow to the valve space 161*a* through the outlet 185*b*.

In addition, the second valve unit 180 of the present disclosure is positioned to be fixed to the casing 110. As illustrated in FIG. 4, the valve housing 185, which forms an appearance of the second valve unit 180, may be positioned outside the casing 110 and fixed to the casing 110.

Here, for the purpose of exchanging the refrigerant, the inlet passage 183*a* and the outlet passage 183*b* may penetrate through an outer circumferential surface of the casing 110. The inlet passage 183*a* and the outlet passage 183*b* may be connected to an intermediate pressure hole 161*g* and a differential pressure hole 161*e* formed to penetrate through the back-pressure plate 161, respectively, so as to communicate with the back-pressure space 160*a* and the valve space 161*a* formed inside the backpressure chamber assembly 160, respectively.

Meanwhile, the first valve unit 170 may have a leakage passage 155*c*. In this embodiment, the leakage passage 155*c* allows the suction space 111 and the valve space 161*a* to communicate with each other to implement an open state of the bypass valve 155.

In an embodiment of the present disclosure, the leakage passage 155*c* may be formed as a gap between the valve space 161*a* and the bypass valve 155. For example, an outer diameter of the bypass valve 155 and an inner diameter of the valve space 161*a* may be designed to have a minute difference from each other, so that the leakage passage 155*c* may be formed when the bypass valve 155 and the valve space 161*a* are coupled. Alternatively, as illustrated in FIGS. 6A and 6B, the leakage passage 155*c* may be formed as a recess which is recessed on the outer circumferential surface of the bypass valve 155.

As a result, the upper end of the leakage passage 155*c* may communicate with the valve space 161*a* and the differential pressure space 161*b*, and the lower end may communicate with the discharge groove 161*d*. Here, a flow path cross-sectional area of the leakage passage 155*c* may be formed to be smaller than a flow path cross-sectional area of the outlet passage 183*b* in which the second valve unit 180 and the valve space 161*a* communicate with each other. This is to allow the refrigerant supplied to the outlet passage 183*b* to stay and maintain sufficient pressure to press the bypass valve 155 in the valve space 161*a* or the differential pressure space 161*b*.

A process in which capacity is varied in the structure of the present embodiment described above will be described with reference to FIGS. 6A and 6B.

FIG. 6A illustrates a power operation state in which the bypass valve 155 seals the bypass hole 151*b*. As illustrated, the second valve unit 180 is controlled so that the opening and closing member 182 is opened to allow the inlet 185*a* and the outlet 185*b* to communicate with each other. The second valve unit 180 may be formed in a solenoid type in which the opening and closing member 182 is moved as power is supplied to a power supply unit 181. As illustrated, a state in which power supply to the power supply unit 181 is off may be a power operation mode.

When the inlet 185*a* and the outlet 185*b* communicate with each other, the intermediate pressure refrigerant present in the back-pressure space 160*a* passes through the intermediate pressure hole 161*g* and the inlet passage 183*a* in turn and is introduced to the inlet 185*a* of the second valve unit 180. Subsequently, the intermediate pressure refrigerant sequentially passes through the outlet passage 183*b* and the differential pressure hole 161*e* and is introduced to the differential pressure space 161*b* and the valve space 161*a*. The refrigerant presses a back-pressure surface 155*b* which is an upper end surface of the bypass valve 155, while filling the valve space 161*a*, and the bypass valve 155 is moved downwards to close the bypass hole 151*b*.

Meanwhile, FIG. 6B illustrates a saving operation state in which the bypass valve 155 opens the bypass hole 151*b*. When the saving operation is necessary, the opening and closing member 182 of the second valve unit 180 is moved so as to close the inlet 185*a* and the outlet 185*b*. As power supply to the power supply unit 181 of the second valve unit 180 is turned on, the opening and closing member 182 may be moved to close the communication space 185*c* as illustrated.

The refrigerant in the valve space 161*a* and the differential pressure space 161*b* may leak to the suction space 111 through the leakage passage 155*c* and the discharge groove 161*d* in a state in which the inlet 185*a* and the outlet 185*b* are closed with each other. As a result, refrigerant pressure in the valve space 161*a* and the differential pressure space 161*b* may be equal to pressure in the suction space 111. Further, as an opening and closing surface 155*a* which is a lower end surface is pressed by the refrigerant discharged through the bypass hole 151*b*, the bypass valve 155 may be pushed upwards. In this manner, in the saving operation, the space in which the bypass hole 151*b* in the compression chamber P is opened and the suction space 111 may communicate with each other through the bypass hole 151*b* and the discharge groove 161*d*. Accordingly, pressure of the refrigerant compressed in the compression chamber P and a flow rate of the refrigerant may be reduced and the compression capacity may be varied.

As described above, in the scroll compressor of the present disclosure, the second valve unit 180, which is a part of the component for performing capacity varying, may be positioned to be fixed to the casing 110. Accordingly, the weight of the back-pressure plate 161 may be reduced compared to the related art, so that the operation of pressing the second scroll 150 may be performed quickly and driving force may be reduced. Furthermore, the bypass valve 155 may be moved by ON/OFF of the second valve unit 180 fixed to the casing 110 even when the capacity varying operation is performed, so that the operation mode may be switched quickly and economically.

In addition, since the valve for switching on/off the one inlet 185*a* and the one outlet 185*b* is applied to the second valve unit 180, a simple piping structure, compared with the related art structure in which three inlets and three outlets are provided. Therefore, the scroll compressor of the present disclosure is advantageous in terms of manufacturing cost reduction and reliability improvement.

In the above, the embodiment of the present disclosure in which the capacity is varied by the first and second valve units 170 and 180 has been described. Hereinafter, another embodiment of the present disclosure in which the leakage passage 155*c* is separately designed to further improve operational reliability of the bypass valve 155 will be described.

Figure 7A:
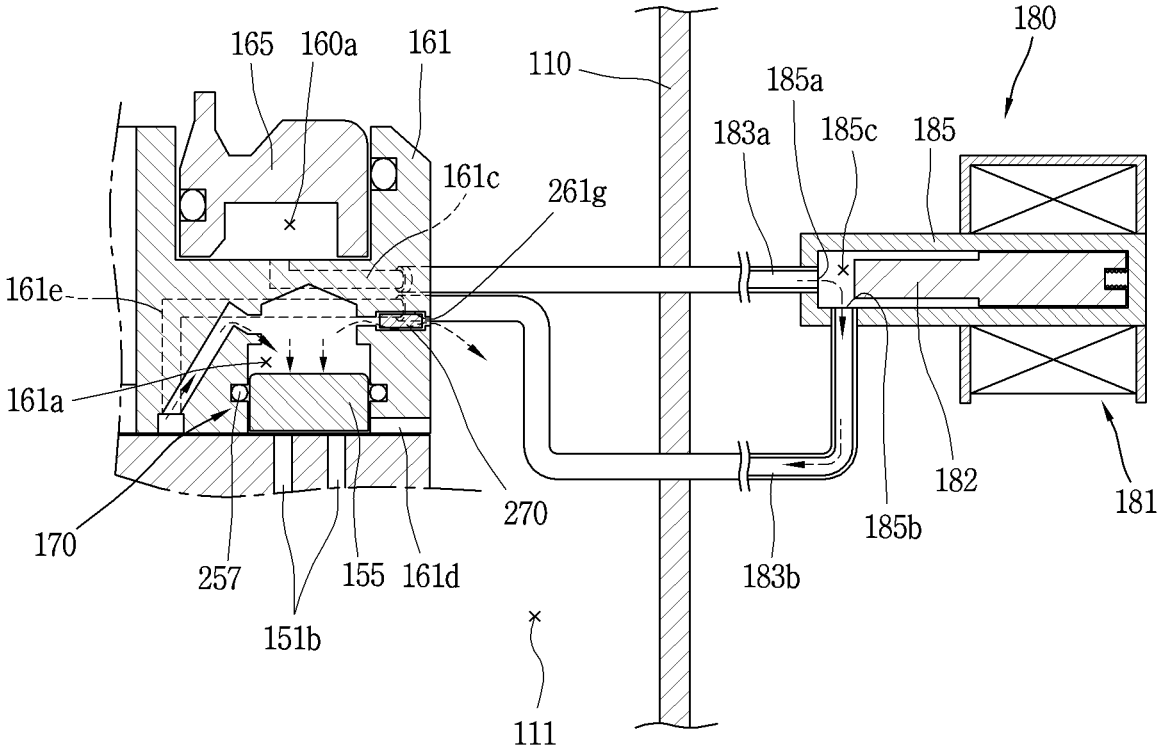
FIGS. 7A and 7B are conceptual views illustrating operational states of a back-pressure chamber assembly when an operation mode is changed in a scroll compressor according to another embodiment of the present disclosure.
Figure 7B:
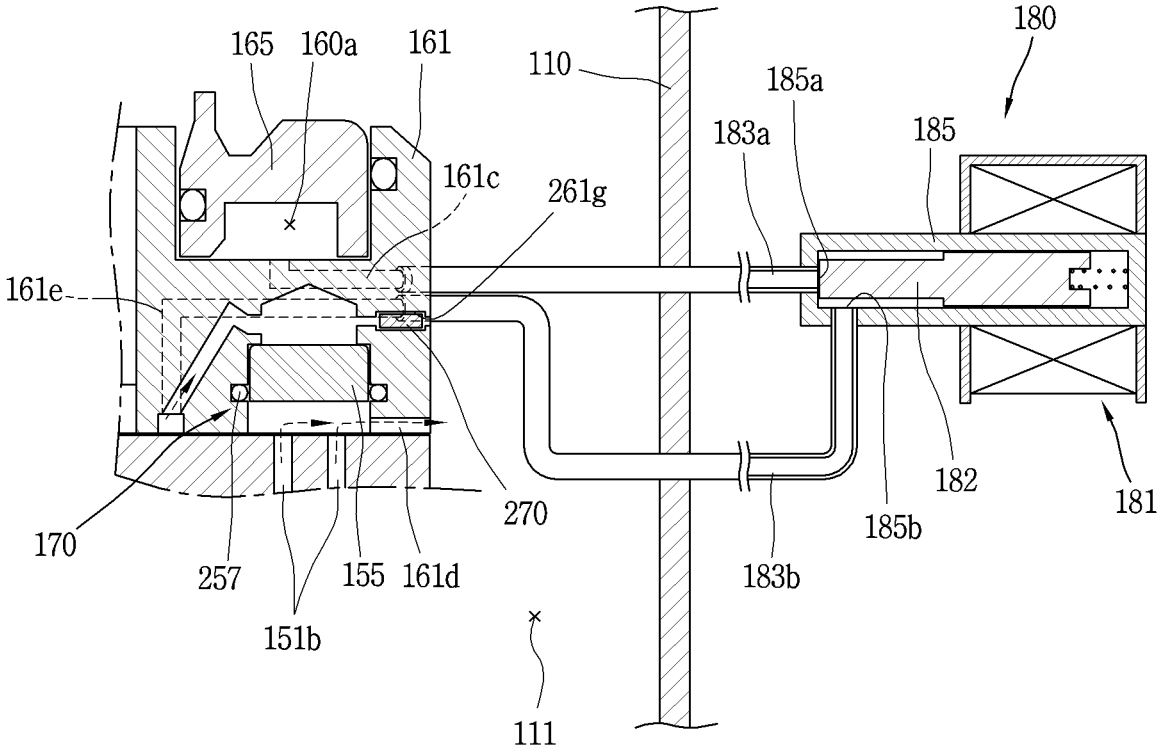

FIGS. 7A and 7B are conceptual views illustrating operation states of the back-pressure chamber assembly 160 according to operation modes in the scroll compressor according to another embodiment of the present disclosure. Referring to FIGS. 7A and 7B, the back-pressure chamber assembly 160 according to another embodiment of the present disclosure further includes a leakage passage 261*g* and a pressure reducing member 270.

The leakage passage 261*g* may be formed to penetrate through the back-pressure plate 161 and allow the valve space 161*a* and the suction space 111 to communicate with each other. As illustrated, for example, one end of the leakage passage 261*g* is opened to the outer circumferential surface of the back-pressure plate 161 and the other end is opened to the inner surface of the back-pressure plate 161 forming the valve space 161*a*.

Also, the pressure reducing member 270 may be inserted into the leakage passage 261*g*. The pressure reducing member 270 is a component for maintaining a difference in refrigerant pressure between the valve space 161*a* and the suction space 111 by reducing a flow path cross-sectional area of the leakage passage 261*g*. Particularly, if the flow path cross-sectional area of the leakage passage 261*g* for maintaining an appropriate decompression level is too small, the required flow path cross-sectional area may be formed by inserting the pressure reducing member 270 after the leakage passage 261*g* is formed.

In the case of the present embodiment in which the leakage passage 261*g* is separately formed, a gap between the inner surface of the valve space 161*a* and the outer circumferential surface of the bypass valve 155 may be sealed by a sealing member 257. The sealing member 257 may be inserted into the inner surface of the back-pressure plate 161 forming the valve space 161*a* and slidable on the outer circumferential surface of the bypass valve 155. For example, the sealing member 257 may be an O-ring.

According to another embodiment of the present disclosure, the bypass valve 155 may be brought into close contact with the valve space 161*a* and stably slide. This reduces a risk of malfunction due to a difference between a direction of pressure applied to the opening and closing surface 155*a* and the back-pressure surface 155*b* and a direction in which the bypass valve 155 is moved. Therefore, operational reliability of the bypass valve 155 may be further improved.

In case where the bypass valve 155 and the valve space 161*a* are slightly spaced from each other to form the leakage passage 155*c* as in the previous embodiment, tolerance management of the bypass valve 155 and the valve space 161*a* may be costly. In contrast, in the present embodiment, since the pressure difference may be adjusted by machining and replacing the pressure reducing member 270, manufacturing convenience may be improved.

Meanwhile, the scroll compressor according to the present disclosure may have a structure as in another embodiment of the present disclosure described below, as well as the above-described one embodiment and other embodiments of the present disclosure.

Figure 8A:
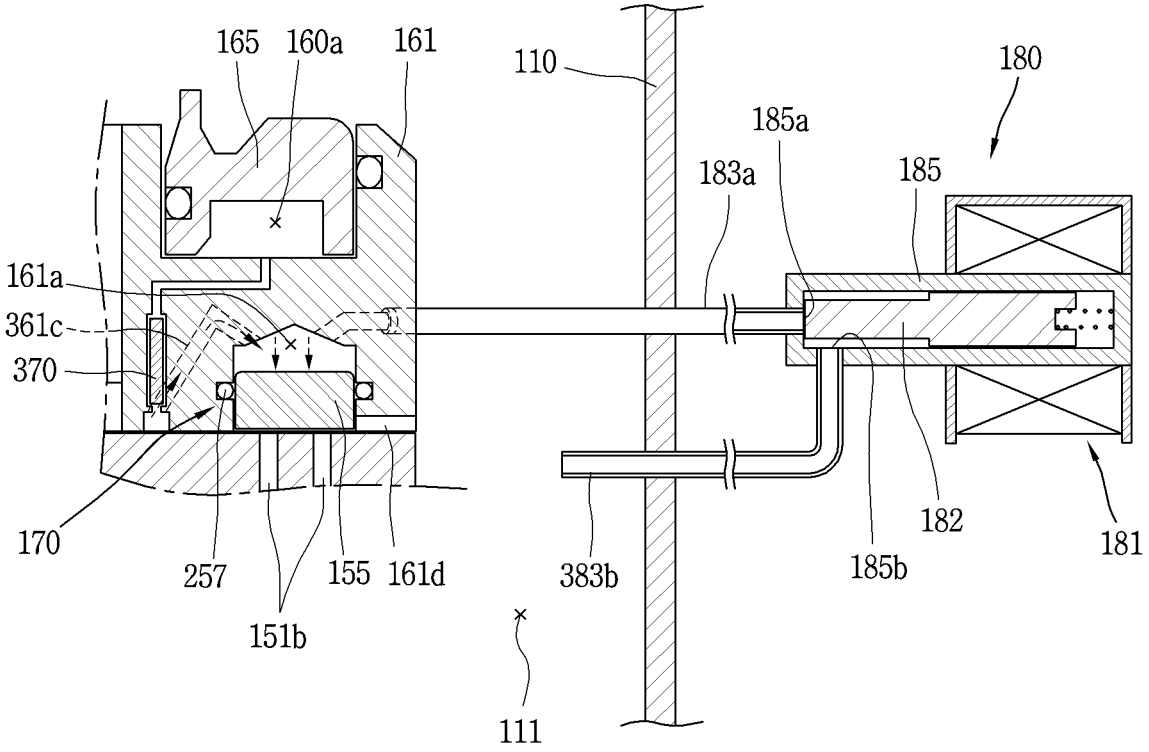
FIGS. 8A and 8B are conceptual views illustrating operational states of a back-pressure chamber assembly when an operation mode is changed in a scroll compressor according to another embodiment of the present disclosure. FIG.
Figure 8B:
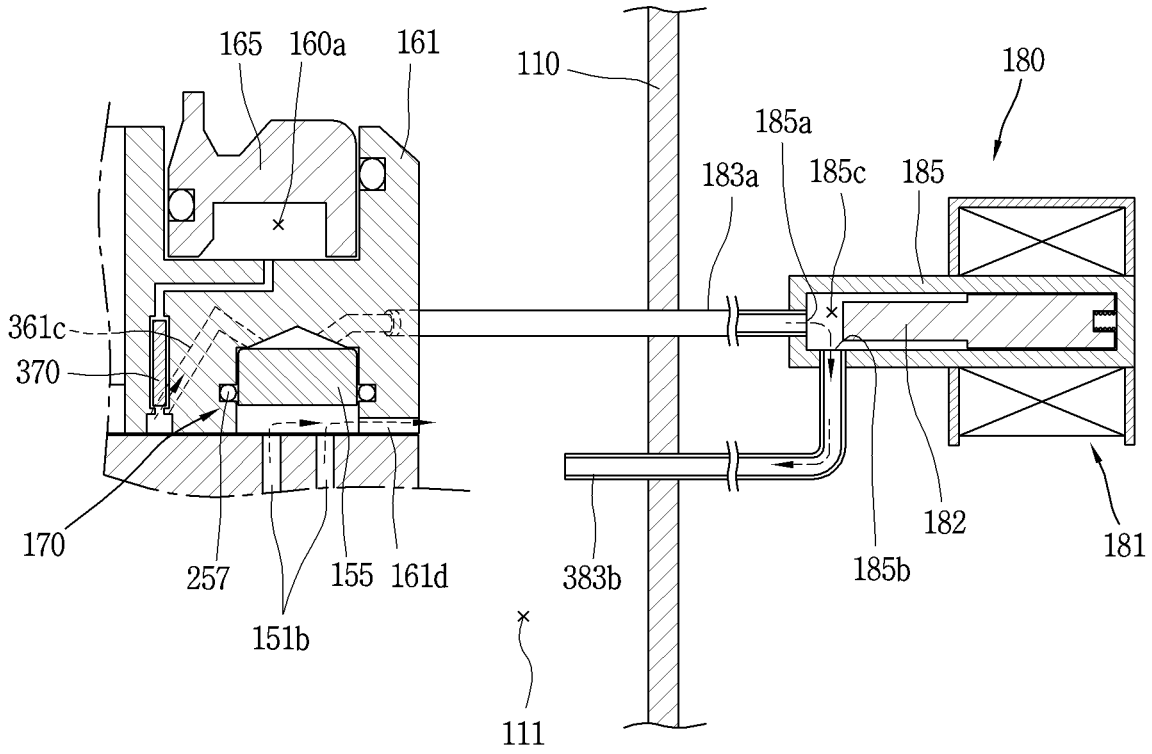

FIGS. 8A and 8B are conceptual views illustrating operational states of the back-pressure chamber assembly 160 according to operation modes in the scroll compressor according to another embodiment of the present disclosure. In another embodiment of the present disclosure, a second valve unit 180 may be connected between the valve space 161*a* and the suction space 111. That is, in this embodiment, an operation of the bypass valve 155 may be controlled by opening and closing a flow path corresponding to the leakage passage 261*g* described in the foregoing embodiment by the second valve unit 180.

Specifically, the back-pressure chamber assembly 160 may be provided with an intermediate pressure passage 361*c* allowing the back-pressure space 160*a* and the valve space 161*a* to communicate with each other. The second valve unit 180 may further include an inlet passage 183*a* allowing the inlet 185*a* and the valve space 161*a* to communicate with each other and an outlet passage 383*b* allowing the outlet 185*b* and an internal space (in particular, the suction space 111) of the casing 110 to communicate with each other. In addition, the pressure reducing member 370 may be inserted into the intermediate pressure passage 361*c*.

In the power operation state illustrated in FIG. 8A, the opening and closing member 182 in the second valve unit 180 may maintain a state of closing the inlet 185*a* and the outlet 185*b*. The suction space 111 and the valve space 161*a* are blocked by the second valve unit 180 and the back-pressure space 160*a* and the valve space 161*a* communicate with each other. In this state, the intermediate pressure refrigerant present in the back-pressure space 160*a* is introduced to the valve space 161*a* to press the back-pressure surface 155*b* of the bypass valve 155. The bypass valve 155 with the back-pressure surface 155*b* pressed may be moved downwards and positioned to close the bypass hole 151*b*.

Here, the pressure reducing member 370 may be designed so that pressure of refrigerant in the valve space 161*a* is sufficient to press and move the bypass valve 155. Specifically, the size of the pressure reducing member 370 may be designed in consideration of the fact that pressure may be increased as the outlet of the valve space 161*a* is closed by the second valve unit 180 in the power operation state.

In the saving operation state illustrated in FIG. 8B, the opening and closing member 182 of the second valve unit 180 may be positioned to allow the inlet 185*a* and the outlet 185*b* to communicate with each other. Accordingly, the valve space 161*a* and the suction space 111 may be in a communicating state. In this state, pressure of the refrigerant in the valve space 161*a* may be lowered to a suction pressure level of the suction space 111, so that the bypass valve 155 may be moved upwards by pressure of the refrigerant discharged through the bypass hole 151*b*. That is, since the bypass valve 155 is positioned to open the bypass hole 151*b*, the refrigerant of the intermediate pressure chamber may be bypassed to the suction space 111 through the discharge groove 161*d*.

In this embodiment, the pressure reducing member 370 may be designed to form an appropriate pressure difference between the back-pressure space 160*a* and the valve space 161*a* in consideration of both the power operation state and the saving operation state.

According to another embodiment of the present disclosure, the suction space 111 and the valve space 161*a* may be closed to each other in the power mode, unlike the previous embodiment. Accordingly, in the power mode, there is no refrigerant leaking finely and the amount of the refrigerant that may be leaked finely when capacity of the scroll compressor according to the present disclosure is varied may be minimized.

The foregoing embodiments and advantages are merely exemplary and are not to be considered as limiting the present disclosure. The present teachings may be readily applied to other types of apparatuses. This description is intended to be illustrative, and not to limit the scope of the claims. Many alternatives, modifications, and variations will be apparent to those skilled in the art. The features, structures, methods, and other characteristics of the exemplary embodiments described herein may be combined in various ways to obtain additional and/or alternative exemplary embodiments.

As the present features may be embodied in several forms without departing from the characteristics thereof, it should also be understood that the above-described embodiments are not limited by any of the details of the foregoing description, unless otherwise specified, but rather should be considered broadly within its scope as defined in the appended claims, and therefore all changes and modifications that fall within the metes and bounds of the claims, or equivalents of such metes and bounds are therefore intended to be embraced by the appended claims.

What is claimed is:

1. A scroll compressor comprising:

a casing that defines an internal space;

a rotary shaft located in the casing;

a driving unit configured to rotate the rotary shaft;

a first scroll located in the casing and connected to the rotary shaft, the first scroll being configured to rotate based on rotation of the rotary shaft;

a second scroll that is engaged with the first scroll, that defines a compression chamber based on engagement with the first scroll, and that defines a bypass hole configured to allow flow of refrigerant from the compression chamber to the internal space of the casing; and a back-pressure chamber assembly that is configured to provide pressure to the second scroll toward the first scroll and that defines a back-pressure space configured to receive the refrigerant and to communicate with the compression chamber, wherein the back-pressure chamber assembly comprises:

a first valve unit that is configured to receive the refrigerant from the back-pressure space and that selectively enables communication between the bypass hole and the internal space of the casing based on operation modes, and a second valve unit that is coupled to the casing, that defines an inlet configured to receive the refrigerant from the first valve unit and an outlet configured to discharge the refrigerant to the internal space of the casing, and that is configured to operate the first valve unit based on allowing or restricting communication between the inlet and the outlet, wherein the back-pressure chamber assembly further defines a leakage passage that enables communication between the first valve unit and the internal space of the casing.

2. The scroll compressor of claim 1, wherein the back-pressure chamber assembly further comprises a bypass valve configured to move relative to the second scroll, the bypass valve being configured to, based on movement relative to the second scroll, separate from the bypass hole and contact the bypass hole, wherein the back-pressure chamber assembly defines a valve space that accommodates the bypass valve, and wherein the leakage passage is recessed from an outer surface of the bypass valve.

3. The scroll compressor of claim 2, wherein the back-pressure chamber assembly further defines an intermediate pressure passage that enables communication between the back-pressure space and the valve space, and wherein the back-pressure chamber assembly further a pressure reducing insert that is located inside of the intermediate pressure passage and that has an outer diameter less than an inner diameter of the intermediate pressure passage.

4. The scroll compressor of claim 1, the back-pressure chamber assembly further comprises a bypass valve configured to move relative to the second scroll, the bypass valve being configured to, based on movement relative to the second scroll, separate from the bypass hole and contact the bypass hole, wherein the back-pressure chamber assembly further defines a valve space that accommodates the bypass valve, wherein the leakage passage extends from an inner surface of the valve space to an outer surface of the back-pressure chamber assembly, and wherein the back-pressure chamber assembly further comprises a pressure reducing insert that is located inside of the leakage passage and that has an outer diameter less than an inner diameter of the leakage passage.

5. The scroll compressor of claim 4, wherein the first valve unit further defines a discharge groove that is configured to communicate with the leakage passage and that enables communication between the bypass hole and the internal space of the casing based on the bypass valve separating from the bypass hole.

6. The scroll compressor of claim 5, wherein the first valve unit is configured to restrict communication between the bypass hole and the discharge groove based on the bypass valve contacting the bypass hole.

7. The scroll compressor of claim 1, wherein the second valve unit comprises:

a valve housing that defines a communication space connected to the inlet and the outlet; and a valve body that is configured to move in the communication space and that is configured to open and close the inlet based on movement in the communication space.

8. A scroll compressor comprising:

a casing that defines an internal space;

a rotary shaft located in the casing;

a driving unit configured to rotate the rotary shaft;

a first scroll located in the casing and connected to the rotary shaft, the first scroll being configured to rotate based on rotation of the rotary shaft;

a second scroll that is engaged with the first scroll, that defines a compression chamber based on engagement with the first scroll, and that defines a bypass hole configured to allow flow of refrigerant from the compression chamber to the internal space of the casing; and a back-pressure chamber assembly configured to provide pressure to the second scroll toward the first scroll, the back-pressure chamber assembly defining a back-pressure space configured to receive the refrigerant and to communicate with the compression chamber, wherein the back-pressure chamber assembly comprises:

a first valve unit that defines a valve space and that selectively enables communication between the bypass hole and the internal space of the casing based on operation modes, the first valve unit comprising a bypass valve located in the valve space, and a second valve unit that is coupled to the casing, that defines an inlet configured to receive the refrigerant from the back-pressure space and an outlet configured to supply the refrigerant to the first valve unit, and that is configured to operate the first valve unit based on allowing and restricting communication between the inlet and the outlet, and wherein the back-pressure chamber assembly defines a leakage passage that enables communication between the valve space of the first valve unit and the internal space of the casing in a state in which the bypass valve closes the bypass hole.

9. The scroll compressor of claim 8, wherein the leakage passage is recessed from an outer surface of the bypass valve.

10. The scroll compressor of claim 9, wherein the first valve unit further defines a discharge groove that is configured to communicate with the leakage passage and that enables communication between the bypass hole and the internal space of the casing based on the bypass valve separating from the bypass hole.

11. The scroll compressor of claim 10, wherein the second valve unit comprises an outlet passage that is connected to the outlet of the second valve unit and that enables communication between the outlet of the second valve unit and the valve space of the first valve unit, and wherein a cross-sectional area of the leakage passage is less than a cross-sectional area of the outlet passage.

12. The scroll compressor of claim 10, wherein the first valve unit is configured to restrict communication between the bypass hole and the discharge groove based on the bypass valve contacting the bypass hole.

13. The scroll compressor of claim 8, wherein the leakage passage extends between an inner surface of the valve space and an outer surface of the first valve unit.

14. The scroll compressor of claim 13, wherein the back-pressure chamber assembly further comprises a pressure reducing insert that is located inside of the leakage passage and that has an outer diameter less than an inner diameter of the leakage passage.

15. The scroll compressor of claim 8, wherein the first valve unit further comprises a sealing member located at an inner surface of the valve space and configured to provide seal between the inner surface of the valve space and an outer surface of the bypass valve.

16. The scroll compressor of claim 8, wherein the second valve unit further comprises:

an inlet passage that is connected to the inlet of the second valve unit and that enables communication between the inlet of the second valve unit and the back-pressure space; and an outlet passage that is connected to the outlet of the second valve unit and that enables communication between the outlet of the second valve unit and the valve space of the first valve unit.

17. The scroll compressor of claim 8, wherein the second valve unit comprises:

a valve housing that defines a communication space connected to the inlet and the outlet; and a valve body that is configured to move in the communication space and that is configured to open and close the inlet based on movement in the communication space.

18. The scroll compressor of claim 8, wherein the back-pressure chamber assembly further comprises a pressure reducing insert located inside of the leakage passage, the pressure reducing insert having a shape corresponding to the leakage passage and extending along the leakage passage.

19. A scroll compressor comprising:

a casing that defines an internal space;

a rotary shaft located in the casing;

a driving unit configured to rotate the rotary shaft;

a first scroll located in the casing and connected to the rotary shaft, the first scroll being configured to rotate based on rotation of the rotary shaft;

a second scroll that is engaged with the first scroll, that defines a compression chamber based on engagement with the first scroll, and that defines a bypass hole configured to allow flow of refrigerant from the compression chamber to the internal space of the casing; and a back-pressure chamber assembly configured to provide pressure to the second scroll toward the first scroll, the back-pressure chamber assembly defining a back-pressure space configured to receive refrigerant and to communicate with the compression chamber, wherein the back-pressure chamber assembly comprises:

a first valve unit that defines a valve space and that selectively enables communication between the bypass hole and the internal space of the casing based on operation modes, the first valve unit comprising a bypass valve located in the valve space, and a second valve unit that is coupled to the casing, that defines an inlet configured to receive the refrigerant from the back-pressure space and an outlet configured to supply the refrigerant to the first valve unit, and that is configured to operate the first valve unit based on allowing and restricting communication between the inlet and the outlet, wherein the back-pressure chamber assembly further defines an intermediate pressure passage that enables communication between the back-pressure space and the valve space, and wherein the back-pressure chamber assembly further comprises a pressure reducing insert that is located inside of the intermediate pressure passage and that has an outer diameter less than an inner diameter of the intermediate pressure passage.

20. The scroll compressor of claim 19, wherein the pressure reducing insert has a shape corresponding to the intermediate pressure passage and extending along the intermediate pressure passage.

* * * * *